United States Patent [19]

Simonds

[11] 4,438,753

[45] Mar. 27, 1984

[54] COMPOUND BOW

[75] Inventor: Gary Simonds, Gainesville, Fla.

[73] Assignee: Kidde Recreation Products, Inc., North Brook, Ill.

[21] Appl. No.: 425,683

[22] Filed: Sep. 28, 1982

[51] Int. Cl.[3] ..... F41B 5/00

[52] U.S. Cl. ..... 124/24 R; 124/DIG. 1

[58] Field of Search ..... 124/23 R, 24 R, 90, 124/25, 1, 86

[56] References Cited

U.S. PATENT DOCUMENTS 3,841,295 10/1974 Hunter ..... 124/24 R 3,851,638 12/1974 Alexander ..... 124/24 R

*Primary Examiner*—Richard J. Apley

*Assistant Examiner*—William R. Browne

*Attorney, Agent, or Firm*—Emory L. Groff, Jr.

[57] ABSTRACT

A compound bow includes improved low-rotation cam members eccentrically mounted upon the bow limp tips and each provided with an enlarged main body section, a reduced width intermediate section and an elongated terminal section generally defining an irregular kidney-shaped profile. A single cable groove or track extends continuously around the entire periphery of each cam and is disposed in a single vertical plane such that any stretch of cable extending between the tracks of the two cams will be substantially aligned with the bow center line. A single continuous cable stretch, having its opposite ends respectively joined to a bowstring and a tension cable, is sheaved about the track of each cam and is adjustably anchored thereto by means of a removable, lockable, rotating keeper whereby fine adjustment of the bow may be achieved without disassembly or removal of any cable lengths from the bow cams. The improved cam members may be employed not only in two-wheel compound bows but also in four and six wheel models.

10 Claims, 5 Drawing Figures

COMPOUND BOW

This invention relates generally to compound bows and more particularly, to an improved low-rotation, eccentrically mounted cam member for mounting at the limb tips of bows of either two, four or six-wheel versions.

Compound bows have become extremely popular among archers during the past 10 years. The broad concept of such bows involves the use of eccentric pulleys, wheels or cams at the limb tips about which the bowstring is sheaved such that when the bow is drawn, the draw force initially rapidly builds up to its maximum intended limit and thereafter noticeably falls off as the bow is fully drawn. The purpose and advantages of such an operation are well known to those skilled in the art and need not be addressed herein.

The majority of compound bows employ a bowstring working in combination with a pair of crossing tension cables, with or without the addition of other pairs of intermediate pulleys or cams. In many instances, the tension cables comprise two lengths of cable each having one of its ends joined to one of the two ends of the bowstring and thereafter passing around an adjacent pulley after which it crosses down or up to a point adjacent the opposite limb tip where it is anchored. An example of this type of compound bow will be found in the patent to Jennings, U.S. Pat. No. 4,241,715 dated Dec. 10, 1980. With such an arrangement, there are really only two free ends of the combined bowstring and tension cable assembly and since the pulley members each have two differently configured adjacent grooves or tracks for regulating the take-up and let-out of the respective cables and bowstring ends, it will be understood that means must be provided to transfer or cross-over each tension cable between the two adjacent grooves of each pulley, such as depicted in the referenced U.S. Pat. No. 4,241,715. This cross-over is necessary in such devices unless the bowstring and tension cable are cut and separately attached to each wheel but in either instance, an imbalance of forces is encountered since laterally adjacent tracks are required in view of the attendant angular displacement of the pulleys over 180°.

Heretofore, bows having the force multiplying means mounted on the limb tips, be they eccentric wheels or shaped cams, have been of such a design that, as the bowstring is drawn from brace height to full draw, the eccentric wheel or cam is displaced through an arc of at least 200° of rotation. Most eccentric wheels and multiple-groove high energy storage cams actually rotate about 250° as the bow is drawn from brace height to full draw.

By the present invention, an improved cam is offered which rotates 180° or less throughout the full range of bow draw yet its unique construction allows the generation of the type of draw force curve sought after with the conventional eccentric wheel, and more importantly, produces a more rounded draw force curve. It is, of course, this broader, more rounded draw force curve that defines the mechanism's ability to store more energy for a given power stroke i.e., the distance the bowstring travels from brace position to full draw.

The minimum or low-rotation concept set forth herein enables the provision of cams having but a single planar tension cable and bowstring groove or track which quite obviously, can not be employed when eccentric wheels or conventional cams are used.

A further shortcoming of multiple grooved cams or wheels is that their use results in an imbalance of limb tip forces due to the difference in bowstring and tension cable loads as the bow is drawn. In a single groove cam such as proposed herein, all loads acting at the limb tip can be balanced about the centerline of the bow or limbs, thus producing less limb twist or torque than is the case with present limb tip mounted cam systems. Further, with conventional cams or eccentrics, the size of the cam or eccentric is directly related to the draw length of the bow whereby in general, the larger the cam the longer the draw length and the smaller the cam the shorter the draw length for a given bow length (i.e. axle to axle distance) and a given brace height. With the instant development low-rotation cams, one is not restricted to reducing the cam size to shorten draw length as the single track cam profile can be programed to decrease cam rotation, thus resulting in shorter draw lengths. In many instances, this unique cam can be used to achieve shorter draw lengths on a given length bow than is presently practical with the conventional large rotation cams or eccentric wheels.

Although a single track cam is illustrated in the drawings, it will be appreciated that the present low-rotation concept may be applied to cams having a plurality of grooves. Such an alternative arrangement of course sacrifices the ease of attainment of balanced limb tip loading and introduces an undesirable weight problem. The significance of seeking to maintain a reduced mass weight lies in the fact that less energy is consumed in accelerating lower mass cams and, at least in theory, more energy is available to accelerate the arrow. Another advantage of the instant cam is that, in the preferred single track version, a single cam design is sufficient to serve for either upper or lower cams and in both right and left hand bows and thus, the number of different manufacturing and stock keeping units is reduced. As will be appreciated, the present cam also allows the use of a single continous or uninterrupted cable length extending from the axle at one limb tip, to and around the cam at the other limb tip and attaching to the bowstring. Thus, at each limb tip, the bowstring cable end does not require separate terminating means along with other attachment means for anchoring a second end of the tension cable.

To accommodate the endless cable stretch in the immediate area of each cam, unique anchor means in the form of a removable keeper is provided whereupon by manipulation of this keeper the cable can be readily attached to, or removed from, each cam without the necessity of threading of the cable through the cam in any manner. Furthermore, by means of the instant keeper, elective fine or course longitudinal or linear adjustment of the cable engaging each cam may be readily achieved without any unstringing of the bow so that the bowstring end portion and the tension cable end portion is easily lengthened or shortened at each cam of the bow.

Accordingly, one of the objects of the present invention is to provide an improved compound bow having single track cams at the limb tips and which describe an arcuate displacement of substantially no more than 180° as the bowstring is manipulated from brace height to full draw.

Another object of the present invention is to provide an improved compound bow cam member comprising a relatively thin vertical element containing a single cable track which extends throughout its entire periphery with this track defining in side elevation a modified kidney-shaped configuration.

A further object of the present invention is to provide an improved compound bow having single track cams at the limb tips each engaged by an endless stretch of cable dipsosed in a single vertical plane and respectively leading to a bowstring and tension cable directed to an opposite bow limb tip.

Still another object of the present invention is to provide an improved compound bow member provided with a single planar cable track throughout its entire periphery and having a displaceable keeper member provided with lock means engaging an exterior periphery of a sheaved cable length to fixedly retain the cable length within a portion of the cam track.

With these and other objects in view, which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 2:
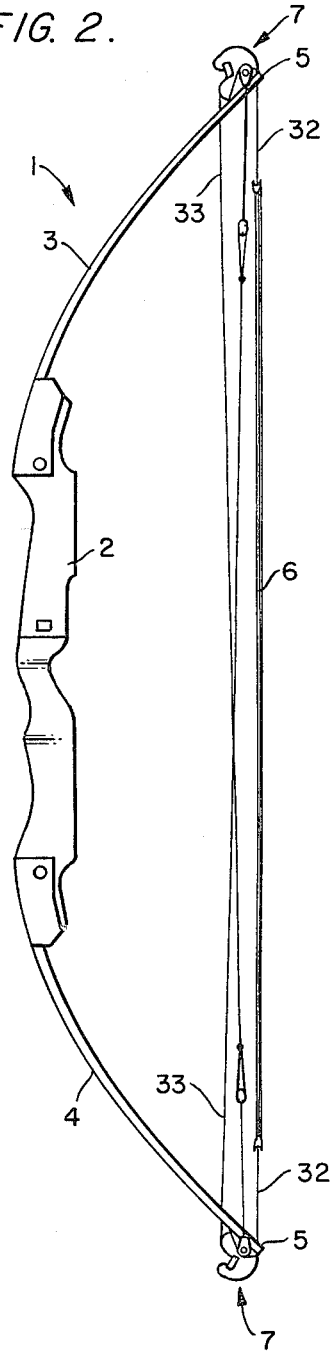
FIG. 2 is a side elevation of a compound bow employing cams of the present invention.

Referring now to the drawings, particularly FIG. 2, the present invention will be seen to relate to a compound bow generally designated 1 and which includes a central handle section 2 bounded by an upper limb 3 and lower limb 4, each having a limb tip 5. The critical aspects of this invention do not involve any particular design of bow handle and limbs as any one of other numerous bow configurations may be employed. The two limbs 3 and 4 must be sufficiently resilient to be deflectable upon manipulation of the bowstring 6 and preferably, means should be provided to allow mounting of the two cams 7 at points adjacent the limb tips 5. In this respect, well known U-shaped metal brackets (not shown) can be used to pivotally mount the cams 7 adjacent the bow limb tips 5, yet a more favorable arrangement is shown in the enlarged view of FIG. 5 of the drawings wherein a central portion of the body of each cam is disposed within a slot 8 formed along the bow centerline and extending through the tip 5. With this construction, the strength of the limb tips are enhanced by the provision of a pair of laterally spaced apart mounting blocks 9—9 which also serve as journal means for the pivot axle 10 supporting the cam 7. This illustrated mounting arrangement is superior to the use of a separate metal bracket as it locates the pivot axle 10 closer to the lateral plane of the limb tips. It is well known to those skilled in the art that excessive mass in the area of the limb tips is detrimental to the smooth, accurate operation of a compound bow.

Figure 3:
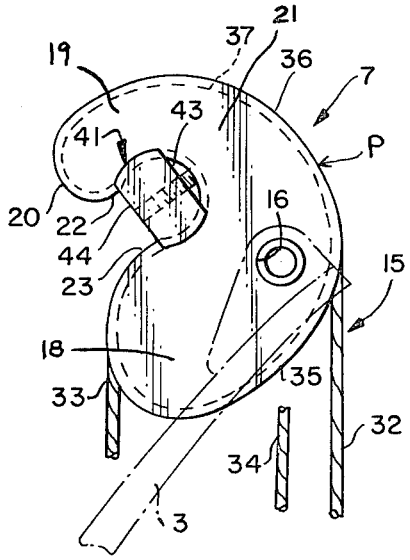
FIG. 3 is an enlarged side elevation of the cam of FIG. 2.
Figure 4:
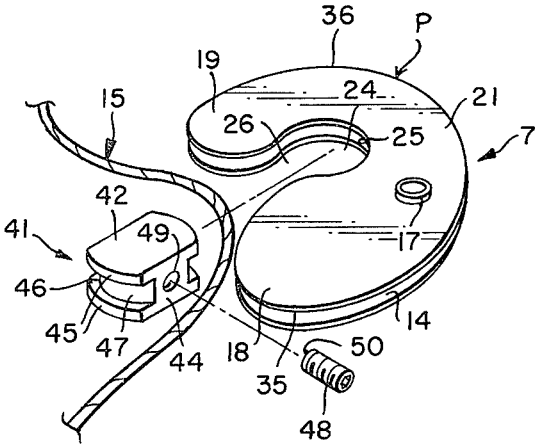
FIG. 4 is an exploded perspective view of the cam of FIG. 3 with the displaceable cable keeper member removed.
Figure 5:
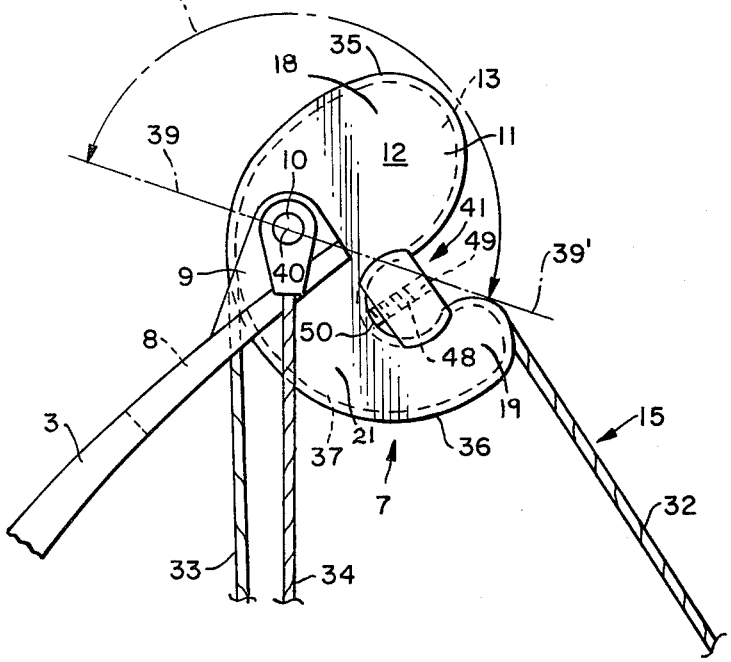
FIG. 5 is a side elevation illustrating the cam of FIG. 3 as it appears when the bow is in a full drawn position.

The details of the construction of the cam 7 will be most readily apparent from a review of the enlarged structure shown in FIGS. 3–5 of the drawings, wherein it will be seen that the cam comprises a flat, thin body 11 having opposite left and right planar and parallel faces 12 and 13. A single, continuous, peripheral groove or track 14 extends about the entire external border, edge or periphery P of the cam and is of a width only slightly greater than the diameter of the cam-engaging continous stretch 15 of the cable. With the cam constructed thusly, with a thickness little more than the diameter of the referenced cable stretch, it will follow that a cam mass is defined which is substantially less than that of many of the eccentric wheels or cams heretofore used. In view of the thin, plate-like construction of the cam 7, it is preferred to reinforce the eccentrically disposed mounting bore 16 therethrough with a suitable collar or bushing 17, the axial extent of which is greater than the thickness of the cam body 11 as shown in FIG. 4 of the drawings.

The configuration of the cam 7 is substantially akin to a modified kidney-shaped arrangement and includes an enlarged main body section 18 normally directed toward the bowstring 6 when the compound bow 1 is in the at-rest position of FIGS. 2 and 3. The opposite end of the cam includes an elongated terminal section 19 of lesser area than the main body section and having a distal tip 20. This terminal section is joined to the enlarged main body section 18 by means of a reduced width intermediate section 21. With the above construction in mind, it will be seen that a distinct inwardly directed cavity is formed between the opposed cam peripheries 22–23 of the terminal section 19 and main body section 18 respectively. More particularly, this cavity comprises a partially circular opening 24 formed by a constant radius periphery 25 comprising portions of all three sections of the cam. This constant radius periphery 25 will be understood to extend an angular distance of greater than 180° for reasons which will become obvious hereinafter and the encompassed partially circular opening 24 defined therewithin communicates with a reduced width neck passage 26 formed by the opposed cam peripheries 22 and 23.

It will be appreciated that the above described cams 7 as used adjacent the limb tip of both the upper and lower limbs 3–4 are identical with the only distinction being in the orientation thereof when attached to the respective limb tip by means of the axle 10 such that one cam is merely inverted with respect to the other cam.

Figure 1:
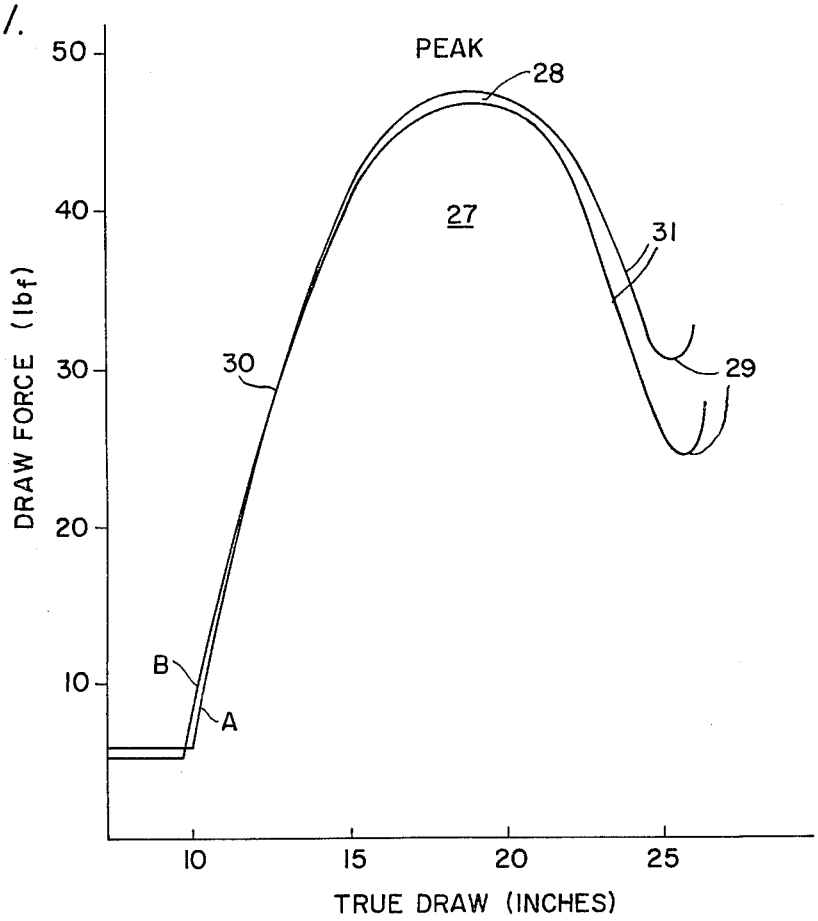
FIG. 1 is a diagrammatic illustration of typical various draw force curves obtainable with the cam of the present compound bow.

Throughout the range of displacement of the cam 7 as the compound bow 1 is manipulated between its at-rest and full-draw positions, the continuous stretch 15 of cable sheaved within the respective cam tracks 14, will be seen to engage a majority of the linear extent of each cam track 14 and merely by programming the profile of areas of each track 14, the resultant draw force curve associated with any one cam may be altered. An important feature of the present invention involves the enlarged stored energy area 27 which is obtainable by use of the cam 7 and which is reflected in the graph of FIG. 1 of the drawings. The draw force curve of two typical cams "A" and "B" are reflected in this drawing figure and it will be appreciated that by merely profiling specific areas of the cam 7 which will be described hereinafter, it is possible to provide a compound bow having a selected peak draw force 28 and full draw point 29. Regardless of the selected programed cam profile, it will be understood that the construction of the instant cam is responsible for the highly desirable enlarged stored energy area 27 which defines an envelope significantly greater than many prior compound bows. The features obtainable with the present cam and which lead to this enlarged area 27 are reflected by the substantially steep and slightly convex rise 30, the substantially flattened or enlarged peak area 28 and the substantially straight let-off curve 31, all of which combine to produce the enlarged area 27.

As previously described, each cam 7 cooperates with a cam-engaging continuous stretch 15 of cable each of which is bounded by a bowstring attachment portion 32 and a tension cable segment 33. From FIG. 2, it will be seen that the distal portion of each bowstring attachment portion 32 is suitably releasably attached to a respective end of the bowstring 6 in any appropriate manner as is well known in the art while the opposite tension cable segment 33 extends toward the opposite limb tip 5 and terminates in a tension cable end portion 34 having its distal portion suitably pivotally attached relatively the limb tip such as engaging the cam mounting axle 10 as shown most clearly in FIG. 5 of the drawings.

Each cam periphery includes a tension cable profile 35 extending peripherally from a point adjacent the neck passage 26 to a point adjacent the cam mounting bore 16. Thus, it will be understood that the tension cable profile 35 encompasses the majority of the periphery of the enlarged main body section 18 of each cam 7. The remainder of the majority of the cam profile comprises a bowstring profile 36 and will be understood to extend from a point adjacent the cam mounting bore 16 and encompasses the entire convex periphery of the reduced width immediate section 21 and extends to an area adjacent the tip 20 of the elongated terminal section 19.

One may more readily correlate the above defined tension cable and bowstring track profiles from a review of the relationship between the cable stretch 15 as depicted in the two extreme positions of FIGS. 3 and 5 of the drawings. In the at-rest position of FIG. 3, the bowstring attachment portion 32 will be seen to be joined to a bowstring cam segment 37 which is fully sheaved within the cam bowstring profile 36 while the tension cable segment 33 only partially engages the cam tension cable profile 35 with the majority of this profile unengaged by any cable portion. However, as the bowstring 6 is drawn, portion 32 of the cable stretch 15 is urged toward the center of the bow 1 and each cam tip 20 is arcuately displaced in a direction away from the bow handle section 2 at a rate determined by the profile 36 of the cams. Concurrently with this draw of the bowstring 6, power is exerted upon each tension cable segment 33 as these latter segments are sheaved within the tension cable profiles 35 and this arcuate displacement and force applied by the various cables continues until the full draw point is reached after which the components of the invention will appear as in the view of FIG. 5 of the drawings. An important point to note is that during this draw of the bow between its two extreme positions, each cam 7 rotates little more than 180° through the arc 38. In this figure, line 39 depicts the angle of the cam tip 20 with respect to the center of the pivot axis 40 of the axle 10 while the line 39 reflects the angle with respect to the pivot axis 40 when the cam tip 20 is displaced to the full draw position.

Attachment, removal or adjustment of the cable stretch 15 is accomplished by means of a removable keeper 41 adapted to cooperate with both the reduced width neck passage 26 as well as partially circular opening 24. As will be seen from the two extreme cam positions of FIGS. 3 and 5, the cable stretch 15 is at all times sheaved within that portion of the cam track 14 extending between the two opposed cam peripheries 22 and 23 and thus the disposition of the keeper 41 at any point between these two areas of the cam track will in no way affect the performance of the cable stretch 15 during operation of the compound bow 1.

The keeper comprises an elongated anchor means having opposite side walls 42—42 spaced apart from one another a greater distance than the thickness of the cam body 11. A portion of the periphery of the keeper comprises parallel inner and outer walls 43 and 44 the distance between which is no greater than the distance between the opposed cam peripheries 22 and 23 such that the keeper may be inserted and removed from the cam opening 24 when aligned as shown in FIG. 4 of the drawings. The opposite ends of the keeper are provided with two spaced apart retainer flanges 45—45 between which is formed a recess 46 the bottom of which is defined by an arcuate cam engaging surface 47. The transverse dimensions of the arcuate surface 47 and thus the distance between the spaced apart retainer flanges 45—45 is slightly greater than the thickness of the cam body 11 while the radius of curvature of the surface 47 is substantially identical to the radius of curvature of that portion of the cam periphery defining the partially circular opening 24.

With the foregoing structure in mind, the operation of the keeper 41 will be readily appreciated. During the installation of a cable stretch 14, a portion of the cable is inserted through the cam neck passage 26 and the keeper 41 is thereafter passed through this neck passage until the two leading retainer flanges 45—45 overlie the respective faces 12 and 13 of the cam body. At this point, the cable stretch 15 within the confines of the partially circular opening 24 will be seated within the adjacent cam track as the leading arcuate cam engaging surface 47 abuts the periphery of the cam. Partial rotation or rocking of the keeper 41 in an angular direction and/or the pulling of either end of the cable stretch 15 enables a selected linear positioning of the cable stretch in a desired position to achieve a particular tuning of the respective attached bowstring 6 and tension cable segments 33. Thereafter, the keeper 41 is rotated 90° from the direction shown in FIG. 4 to that as shown in FIGS. 3 and 5 so that both pairs of spaced apart retainer flanges 45—45 now overlie the respective opposite cam body faces 12 and 13 at diametrically opposed portions of the partially circular opening 24 such that two opposite portions of the cable stretch 15 are now fully seated within the respective juxtaposed areas of the cam track. At this point, a suitable threaded lock element such as the set screw 48 contained within the threaded transverse bore 49, is tightened until its tip 50 is urged to project from the keeper inner wall 43 and bears upon that portion of the cable stretch 15 in the medial area of the cam partially circular opening 24. It will follow that as the lock element 48 is further tightened, a positive pressure will be applied to urge the cable into a locking engagement with the bottom of the cam track. This action is assured since a stationary resistance is offered by the body of the keeper 41 due to the reduced width neck passage 46 formed by the juxtaposed cam peripheries 22–23 which preclude an outward displacement of the keeper when disposed in the transverse position of FIGS. 3 and 5.

From the above, it will be seen that ready means are provided to facilitate the quick adjustment or lengthening/shortening of the cables of a compound bow without the necessity of unstringing same or threading of the cables through bores in eccentric wheels or cam elements. The construction of the present cam maintains perfect symmetry or balance along a vertical plane extending through the centerline of the bow such that the bowstring as well as both tension cable segments 33 are normally disposed through the centerline of the bow limbs and handle section. Quite obviously, a tension cable deflector (not shown) as well known to those skilled in this art, may be included to slightly laterally offset portions of the tension cables intermediate the two limb tips so as to provide an interference-free area for the flight of an arrow.

For the sake of clarity in presenting the distinguishing characteristics of this invention, a relatively simple two-wheel compound bow 1 has been illustrated in the drawings. It will be understood that any one of numerous other types of bows having various alternate cable and pulley arrangements may incorporate the improved cam disclosed herein, such as four and six-wheel compound bows.

I claim:

1. A compound bow including, a handle section, upper and lower limbs extending from said handle section and each having a tip, pivot means for supporting a displaceable member mounted adjacent each said limb tip, a cam attached to each said pivot means and having an irregularly configured external periphery, a cable track in said cam external periphery and disposed in a single vertical plane, said cam when viewed in side elevation including an enlarged main body section joined to an elongated terminal section by a reduced width intermediate section, a continuous stretch of cable sheaved within at least a portion of said track, a bowstring attached to one end of said cable stretch and a tension cable extending from the other end of said cable stretch, said cable stretch adjacent said bowstring engaging said periphery track on said intermediate section, said cable stretch adjacent said tension cable engaging said periphery track on said main body section, portions of said cam periphery track profiled to yield a specific draw force when said bowstring is drawn, said cam arcuately displaced substantially 180° as said bowstring is drawn from brace height to full draw and releasable cable anchor means removably attachable within a configuration formed by the external periphery of said intermediate section so that said anchor means may be forced against said cable stretch in said cam external periphery track in the intermediate section to adjustably secure said cable stretch against linear displacement relative said cam.

2. A compound bow according to claim 1 wherein, said cam defines a substantially kidney-shaped configuration in side elevation.

3. A compound bow according to claim 1 wherein, said cable track extends around the entire portion of said cam periphery.

4. A compound bow according to claim 1 wherein, said cable track is aligned with the center line of said bow handle section and limbs.

5. A compound bow according to claim 1 wherein, each said tension cable comprises an integral extension of one said continuous stretch of cable.

6. A compound bow according to claim 5 wherein, each said tension cable includes an end portion pivotally attached adjacent one said bow limb.

7. A compound bow according to claim 1 wherein, said cam sections are configured to provide a partially circular opening formed by said periphery, a portion of the periphery of said terminal and main body sections spaced apart from one another to provide a reduced width neck passage adjacent said partially circular opening, said cable anchor means comprising an elongated keeper insertable through said neck passage and subsequently rotatable within said opening, and a lock element carried by said keeper operable to fixedly retain said keeper within said opening and to lock said stretch of cable relative said cam track.

8. A compound bow according to claim 7 wherein, said elongated keeper includes a width no greater than the transverse dimension of said reduced width neck passage and a length greater than the transverse dimension of said reduced neck passage whereby, operation of said lock element following rotation of said keeper within said opening urges said keeper toward said reduced width neck passage.

9. A compound bow according to claim 1 wherein, said cable anchor means comprises a keeper insertable over a portion of said stretch of cable disposed within said cam track, and lock means carried by said keeper operable to fixedly secure said keeper to said cam and to lock said stretch of cable relative said cable track.

10. A compound bow including, a handle section, upper and lower limbs extending from said handle section and each having a tip, pivot means for supporting a displaceable member mounted adjacent each said limb tip, a cam attached to each said pivot means and having an irregularly configured external periphery, a cable track in said cam external periphery and disposed in a single vertical plane, a continuous stretch of cable sheaved within at least a portion of said track, a bowstring attached to one end of said cable stretch and a tension cable extending from the other end of said cable stretch, portions of said cam periphery track profiled to yield a specific draw force when said bowstring is drawn, said cam arcuately displaced substantially 180° as said bowstring is drawn from brace height to full draw, releasable cable anchor means radially attachable to said cam and engageable with said cable stretch in said cam external periphery track, said cable anchor means comprising a keeper insertable over a portion of said stretch of cable disposed within said cam track, and lock means carried by said keeper operable to fixedly secure said keeper to said cam and to lock said stretch of cable relative said cable track, opposite left and right faces on said cam, and said keeper provided with an arcuate surface bounded by spaced apart retainer flanges whereby, with said keeper secured to said cam said arcuate surface spans a portion of said cam periphery and overlies said table track with said retainer flanges overlying said cam left and right faces.

* * * * *